US006628571B2

(12) United States Patent
Emami

(10) Patent No.: US 6,628,571 B2
(45) Date of Patent: Sep. 30, 2003

(54) WATCH

(75) Inventor: Arman Emami, Hektorstrasse 14, D-10711 Berlin (DE)

(73) Assignees: Rosemarie Krakow (DE); Arman Emami (DE)

( * ) Notice: Subject to any disclaimer, the term of this patent is extended or adjusted under 35 U.S.C. 154(b) by 0 days.

(21) Appl. No.: 09/992,176

(22) Filed: Nov. 19, 2001

(65) Prior Publication Data

US 2002/0031051 A1 Mar. 14, 2002

Related U.S. Application Data

(63) Continuation of application No. PCT/EP00/04548, filed on May 19, 2000.

(30) Foreign Application Priority Data

May 19, 1999 (DE) ..... 199 23 808

(51) Int. Cl.[7] ..... G04C 19/00; G04B 19/00
(52) U.S. Cl. ..... 368/82; 368/83; 368/223
(58) Field of Search ..... 368/76, 82–83, 368/223, 239, 241

(56) References Cited

U.S. PATENT DOCUMENTS 3,574,992 A * 4/1971 Ladas ..... 368/82
4,459,034 A * 7/1984 Katawaba ..... 368/240
5,896,348 A * 4/1999 Lyon ..... 368/223

FOREIGN PATENT DOCUMENTS

JP 355090884 A * 7/1980 ..... 368/227
JP 355090894 A * 7/1980 ..... 368/233
JP 401280290 A * 11/1989 ..... 368/76

* cited by examiner

*Primary Examiner*—David Martin
*Assistant Examiner*—Michael L. Lindinger
(74) *Attorney, Agent, or Firm*—Pendorf & Cutliff

(57) ABSTRACT

The invention relates to a watch (2), wherein the time is represented by a plurality of display means (4) that are individually activated or deactivated. Said watch includes a first group (31) of display means for the number of hours, a second group (32) of display means for a first position of the number of minutes and a third group (33) for the second position of the number of minutes. The display means (4) in each group preferably form at least three subgroups (311, 312, 313, 314; 321, 322, 323; 331, 332, 333), wherein the groups and subgroups are arranged in such a way that they can be separately and optically perceived and the amount of display means activated in a group correspond to a figure representing the time.

14 Claims, 7 Drawing Sheets

7:23

WATCH

REFERENCE TO RELATED APPLICATIONS

This is a continuation of PCT application No. PCT/EP00/04548 filed May 19, 2000.

BACKGROUND OF THE INVENTION

1. Field of the Invention

The invention relates to a watch with a plurality of display means (display segments) which are to be individually activated or deactivated for representation of a time.

2. Description of the Related Art

For representation of time by means of these display means, which are for example luminous segments in the form of bars or similar segments, instead of the usual representation by means of clock hands or digits, a fundamental problem resides in the fact that a relatively large number of these display means is required to identify each time (24 hours with each 59 minutes) by allocating a definite combination of activated or deactivated display means.

A further problem resides in the fact that the time cannot be perceived with a quick look as in the case of representation by means of clock hands or digits, but more or less expensive interpretations of the display means which are actually activated or deactivated are necessary.

Numerous trials have been made to improve the clarity and simplicity of such representations. It is refered to the following documents: (1) DE 38 14 710 A1, (2) DE 20 29 609, (3) DE 23 39 482 C3, (4) DE 88 16 123 U1, (5) DE 88 09 059 U1, (6) EP 04 28 981 A1, (7) EP 02 56 434 A2, (8) DE 41 35 514 ares, (9) DE 41 11 415 A1 and (10) JP 21 66 607.9.

Further, the following documents are cited which respectively disclose different time representations: GB-A-2 043 969, U.S. Pat. No. 3,775,964, DE 41 34 709A, U.S. Pat. No. 5,526,327, WO 99 17173A, as well as: D. Devos: "Horlineacolor 360" in "Journal Suisse d'Horlogerie no. 5/6, 1973, pages 117–118.

Document DE 41 35 514A discloses for example a means for indication of time which is formed by one or more base areas and several display means for hours, minutes and seconds, respectively, which can be moved or activated relativ to the base areas. The indication principle is based on the fact, that the base areas each correspond to a cycle of a time unit, wherein the respective display means cover the base area more and more with advancing time lapse until it is covered completely. By this, the current time shall be readable more simply than with the known clock hand representation. The base areas can have different forms and can be rectangular, circular, pyramidal, cylindrical etc.

However, an essential disadvantage of this is the fact that the exact number of active display means cannot be perceived with a quick look but only a coarse estimate of the ratio between the area which is covered by the active display means and the base area is possible. This problem which particularly becomes obvious from FIG. 8 in said document, is based on the fact that the human eye is not capable of simultaneously, quickly and reliably perceiving more than about four or five display means. If the number of display means is greater than this, it is necessary to count or recount the same to perceive their numer correctly or the display means have to be provided with a scale.

Furthermore, both in case of counting as well as in case of providing a scale, there is a risk that a user who only takes a short look or glance, miscounts or carries out a wrong reading.

SUMMARY OF THE INVENTION

It is an object of the invention to provide a watch with a plurality of display means (display segments) for individually to be activated or deactivated for representation of a time so that the time can be perceived and read more quickly in comparison to the above mentioned means according to the prior art.

This solution combines numerous advantages. By providing separate groups of display means for the numbers of hours and minutes and by subdividing each group into between two and four subgroups, the number of activated display means in each group can be perceived more quickly.

Furthermore, no arithmetic processes are required for interpretation of the representation, because the number of display means activated in a group directly corresponds to the equivalent number of time. This has the advantage that the advancing time lapse corresponds with a linearly increasing number of activated display means, so that the current time is as well represented by a current amount, and the time can also be read by persons who are not (or not yet) familiar with the usually used digit system or clock hand system.

A further advantage of this solution is that driving of the display means for activation is relatively simple because with advancing time lapse the display means of a group are activated respectively one after each other and progressively.

Because the display means must show only two optically differentiable states which are taken by activation or deactivation, there is the possibility to provide a watch with an all around display which is readable from all sides simultaneously.

The embodiment in accordance with a preferred embodiment wherein the display means (4) of a first group (31) are activated for indication of an hour number between 1 and 12 o'clock starting at a first end of the row and and for indication of an hour number between 13 and 24 o'clock starting at the second end of the row has the advantage that on the one hand the first group for the number of hours needs to comprise only twelve display means and that on the other hand, however, a distinction is nevertheless possible between a time in the morning and a numerically similar time in the afternoon.

The embodiments wherein the display means (4) of the first group (31) are combined to four subgroups (311, 312, 313, 314) which each comprise three display means; or where the display means (4) of the second group (32) form three subgroups (321, 322, 323) wherein two subgroups (321, 322) each comprise two display means; or where the display means (4) of the third group (33) form three subgroups (331, 332, 333) which each comprise three display means, are all particularly advantageous subdivisions of the groups into subgroups as well as their respective numbers of display means.

By the embodiment wherein the optically separated perceivability of the groups (31, 32, 33) and/or subgroups (311, 312, 313, 314; 321, 322, 323; 331, 332, 333) is achieved by optically perceptible means, the indication can even more quickly and more surely be perceived.

The embodiments wherein the display means (4) are formed by luminous elements which are switched on for activation and which are switched off for deactivation; or in which the display means are formed by liquid crystal display elements which are activated or deactivated by contrast change; or in which the display means are each formed by a shutter element (8, 81) which is activated or deactivated by a mechanical change of position, each exemplify different kinds of elements to be used as display means are disclosed wherein however also other display means can be used, provided that these display means can take two differentiable states which can be triggered by activation or deactivation.

In a further embodiment according to the invention, by using the same display means an indication of a date in the form of the numbers of a month and a day can be represented instead of the numbers of the hour and minute. Alternatively, it is possible to indicate minutes and seconds or seconds and one tenth of seconds or—if the display is extended by two more groups of display means—to indicate simultaneously hours, minutes and seconds.

In a further embodiment a watch can be provided in a simple way which can be read from around all directions simultaneously.

BRIEF DESCRIPTION OF THE DRAWINGS

Further details, characteristics and advantages of the invention become apparent from the following description of preferred embodiments with respect to the drawings in which shows.

DETAILED DESCRIPTION OF THE INVENTION

Figure 1A:
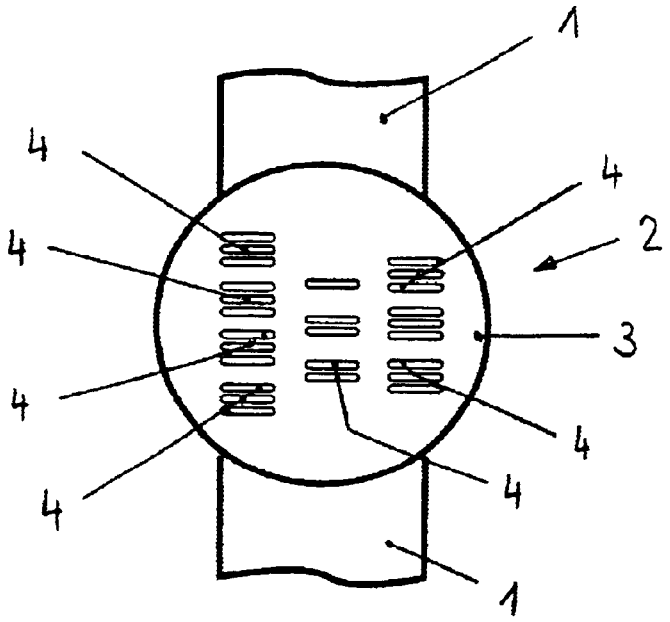
FIGS. 1*a,b* schematic representations of a first embodiment of such a watch.

FIG. 1*a* shows exemplarily a first embodiment in the form a wristwatch with a strap 1 at which the watch 2 is fastened. The clockface 3 of the watch comprises a plurality of display means 4 which are combined into three groups and which are within a group separately arranged in several subgroups.

Figure 1B:
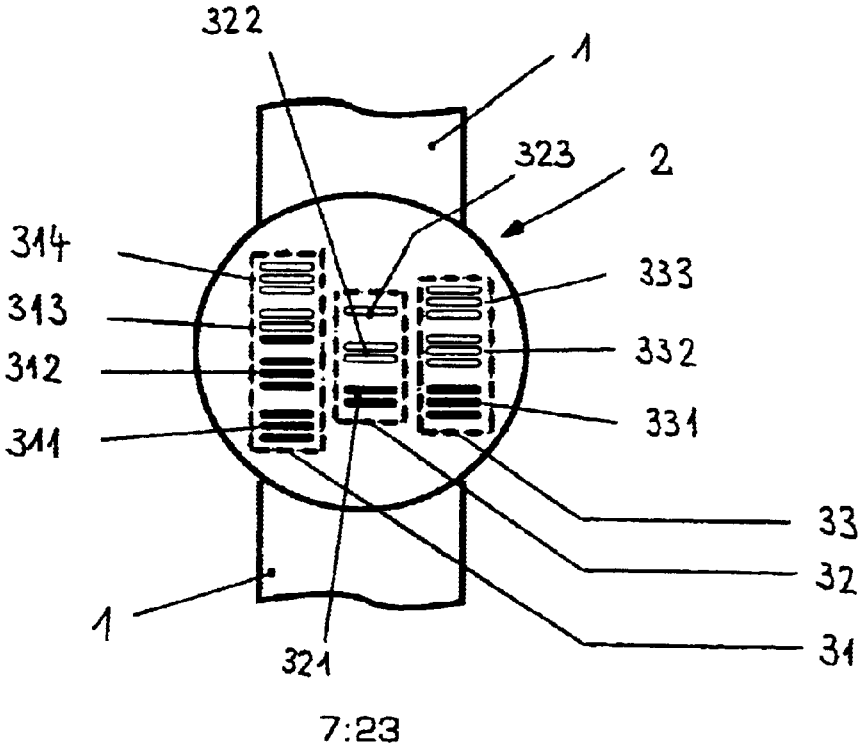

In detail, according to FIG. 1*b* there is a first group 31 of display means for an hour number, a second group 32 of display means for a first place of a minute number and a third group 33 of display means for a second place of a minute number. The individual groups are in turn each subdivided in subgroups.

Twelve display means are provided for indication of an hour number between 0 and 12, which are arranged within the first group 31 in four subgroups 311, 312, 313, 314 which each comprise three display means. Five display means are provided for indication of the first place of the minute number between 0 and 5, which are arranged within the second group 32 in three subgroups 321, 322, 323 which each comprise two or one display means. Finally, nine display means are provided for indication of the second place of the minute number between 0 and 9, which are arranged within the third group 33 in three subgroups 331, 332, 333 which each comprise three display means.

The number of display means in every subgroup should not exceed three to not impair the quick recognizability of the number of activated display means within a group.

As indicated in FIG. 1*b* seven display means of the first group 31, two display means of the second group 32 and three display means of the third group 33 are activated so that the time is indicated as 7 h 23 min. In this representation the display means of one group are activated continuously up from below so that the number of the display means activated in one group corresponds to the number of the place of the time to which this group is assigned to.

Figure 2:
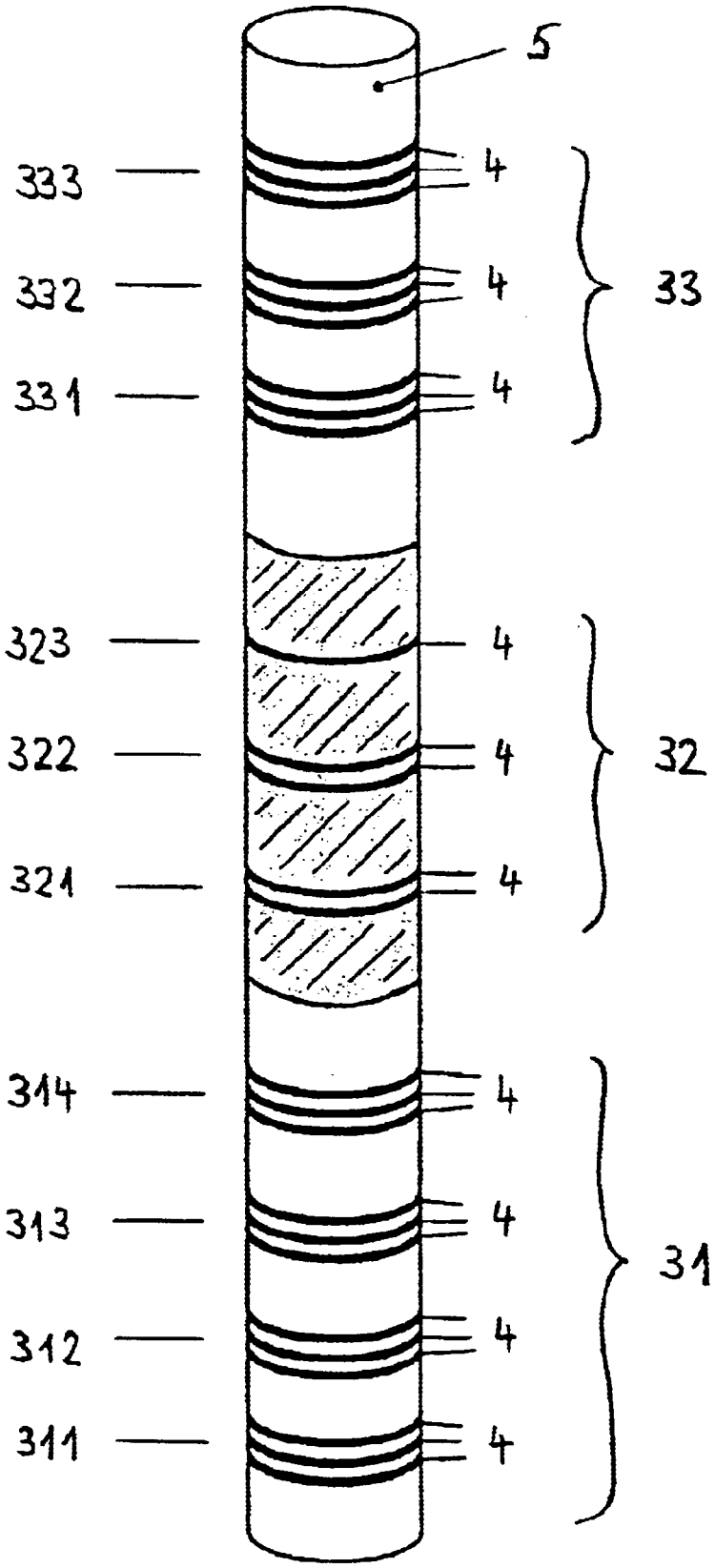
FIG. 2 a schematic representation of a second embodiment of the watch.

FIG. 2 shows a second embodiment of the inventive watch in which the groups 31, 32 and 33 of the display means are arranged side by side along a bar 5. Every group again comprises subgroups 311, 312, 313, 314; 321, 322, 323; 331, 332, 333 as described in connection with FIG. 1*b* above, wherein each subgroup comprises one, two or three display means 4. Because the display means are provided in the form of closed rings running around the bar 5, this embodiment enables a reading of the time from all directions around the bar axis.

The bar 5 can be also be provided in the form of a cylindrical liquid crystal display, along which the display means are activated and deactivated, respectively, by an appropriate driving of the liquid crystal display.

Figure 3:
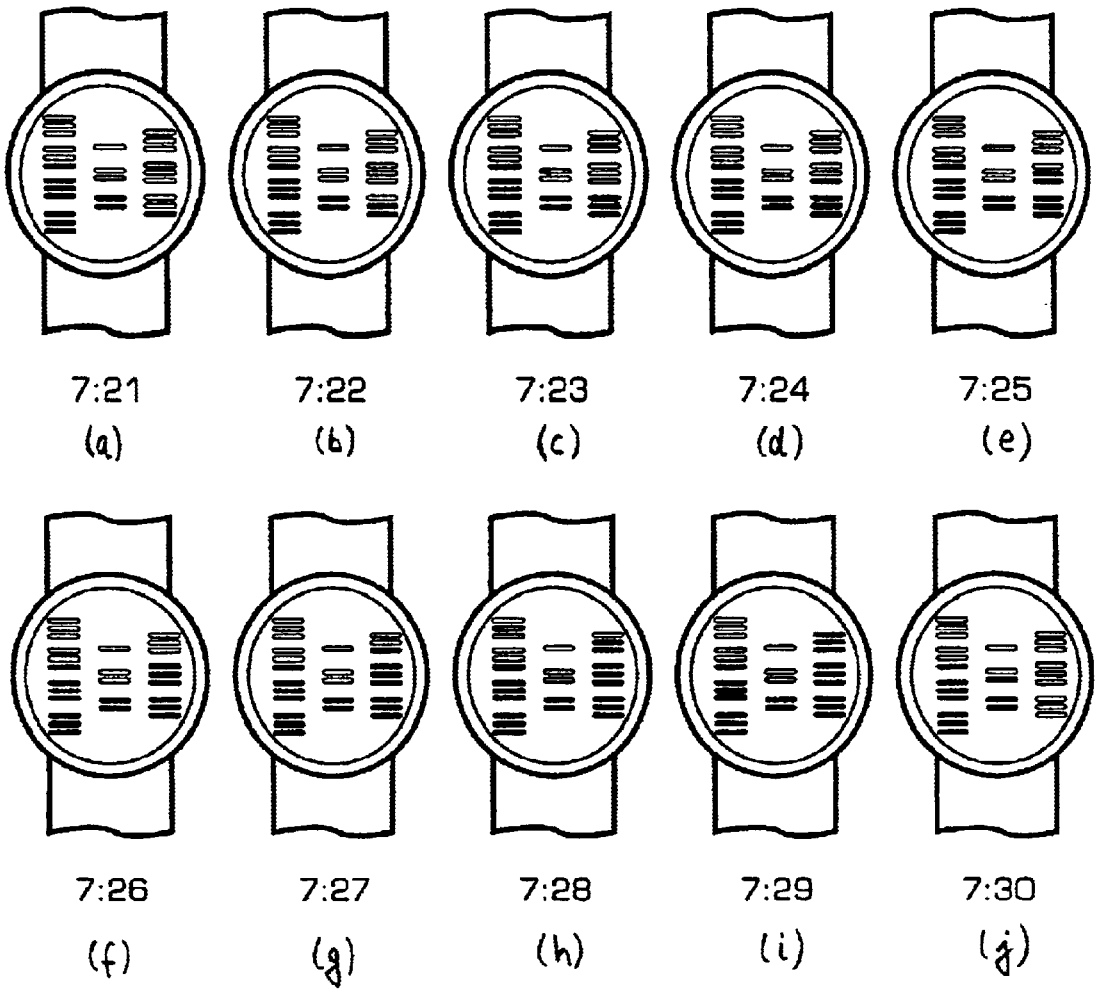
FIGS. 3*a–j* different times, which are indicated with the first embodiment.

For the first embodiment of the invention FIG. 3 shows the ongoing (continuing) change of the indication in times of minutes between a time of 7 h 21 min (FIG. 3*a*) and of 7 h 30 min (FIG. 3*j*). This representation makes clear, that in the first group 31 the first seven display means are activated and that in the second group 32 for the times between 7 h 21 min and 7 h 29 min the first two display means are activated. In the third group 33, according to the ongoing minute place between the time 7 h 21 min and the time 7 h 29 min, are each one, two, three, . . . nine display means (FIG. 3*a* to FIG. 3*i*) respectively activated. For the representation of the time 7 h 30 min, in the second group 32 three display means are activated in accordance with FIG. 3*j* and in the third group 33 all display means are deactivated.

Figure 4:
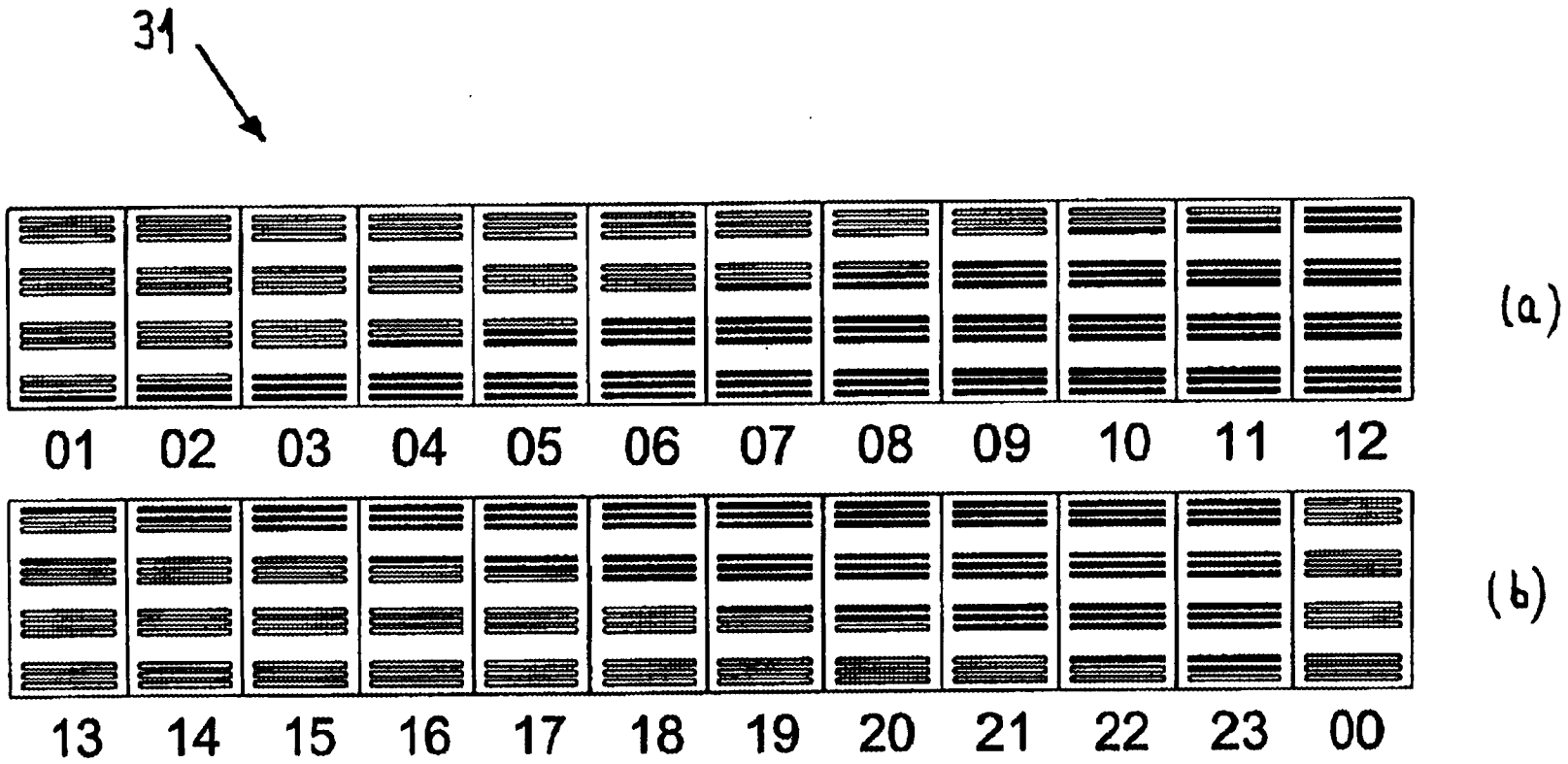
FIG. 4 the differing manner of indication of an hour in the morning and in the afternoon, respectively.

FIG. 4 shows the principle by which the indication of the hours in the first group 31 is distinguished between the same hour numbers in the morning and in the afternoon. In accordance with FIG. 4*a* the hours between 1 and 12 o'clock, i.e. in the morning, are represented, according to the usual way for the minute places, with increasing hour number (in FIG. 4*a* from the left to the right) by the correspondingly increasing number of display means activated upwards from below. For the hours between 13 and 24 o'clock, i.e. in the afternoon, this direction is reversed. This means that the display means are activated in accordance with FIG. 4*b* starting above in the direction to below after each other with increasing number according to the correspondingly increasing hour number.

Figure 5:
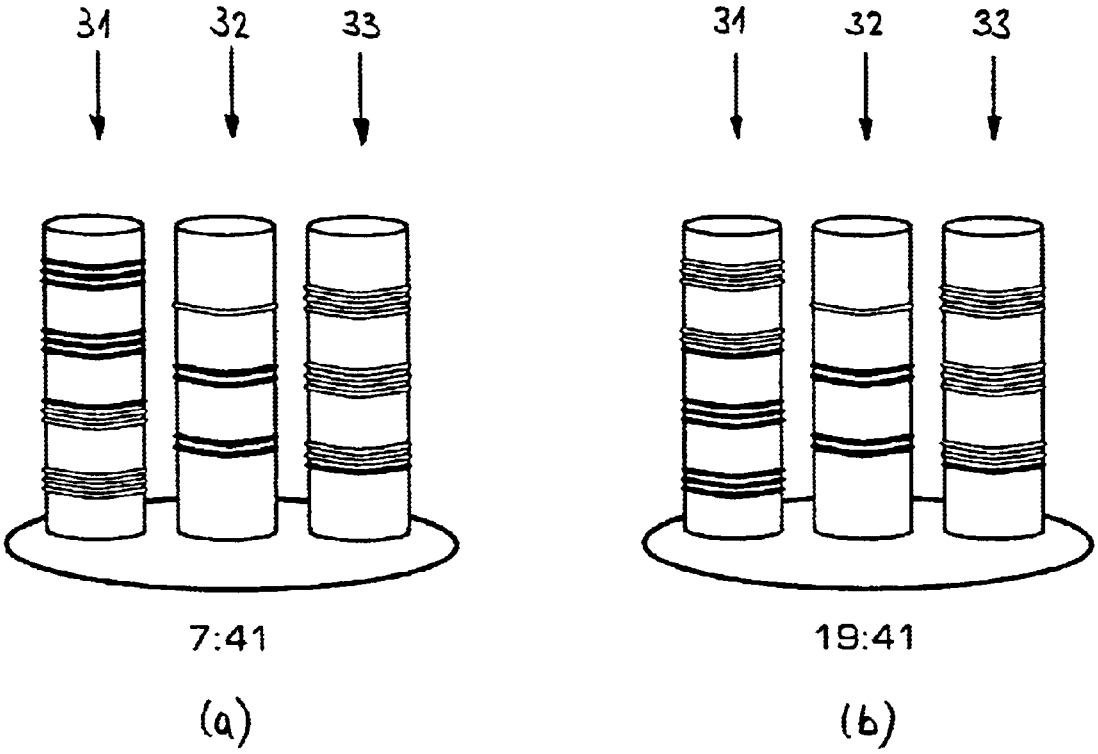
FIGS. 5*a,b* an example of a complete time indication in the morning and in the afternoon, respectively.

FIG. 5 again shows this principle for 7 h 41 min (FIG. 5*a*) and 19 h 41 min (FIG. 5*b*), respectively, however, in this representation in a direction opposite to FIG. 4. For the hour number in the morning the first seven display means of the first group 31 are activated and counted starting from above while for the same hour number in the afternoon the first seven display means of this group 31 are activated and counted starting from below. The indication of the first and second minute place with the second and third group 32, 33, respectively, remains unchanged.

Figure 6:
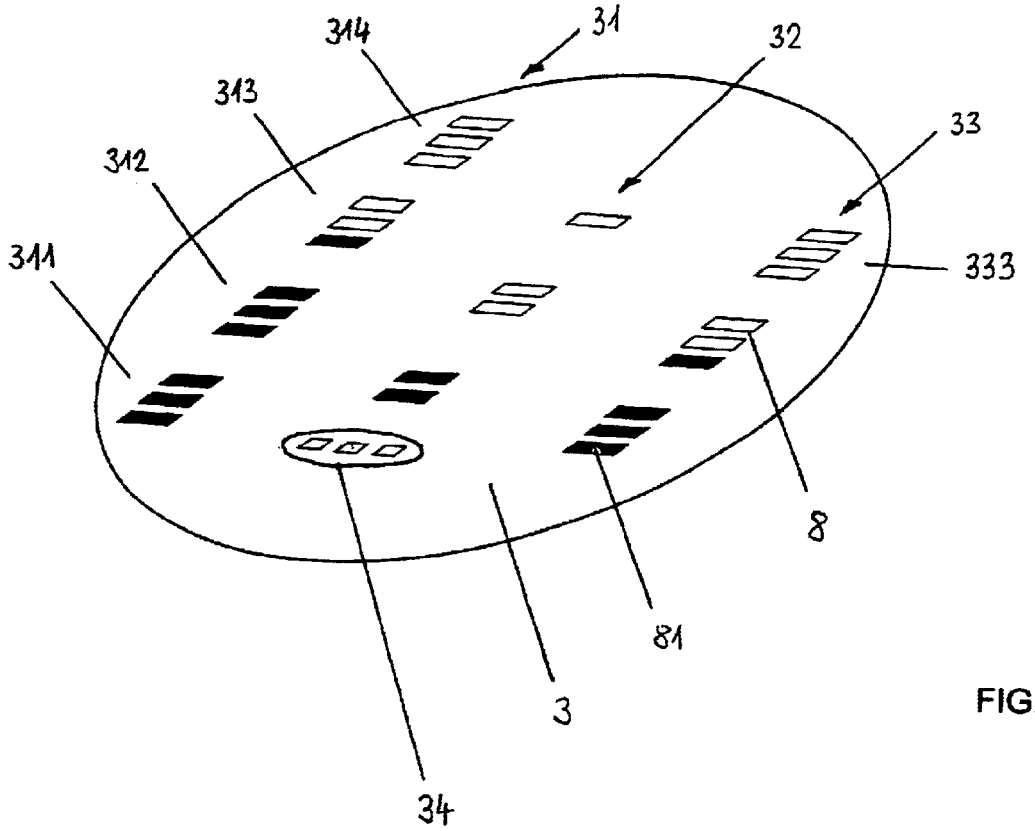
FIG. 6 an example of an embodiment of an indication.

FIG. 6 shows a dial 3 with three groups 31, 32, 33 of display means as well as an indicator 34. If the watch is provided with a switching unit for switching between the indication of time, the indication of seconds and tenth of seconds and the indication of the date, respectively, then this indicator 34 signals which of these indications is currently switched on.

Further, this Figure shows an embodiment of the display means in the form of mechanical shutter elements. Each display element is provided by a cutout 8 in the dial 3 and an underlying shutter 81 which can mechanically be moved or shifted in such a way that it is visible when the display means is activated and invisible when the display means is deactivated.

For example, the shutter elements can be switched, i.e. activated and deactivated, by a mechanical clockwork mechanism. Further, activation and deactivation of the display means can be performed by providing a roll (not illustrated) under each of the groups 31, 32, 33 which extends respectively along the row of cutouts 8 and comprises markings or colour ranges in such a way that when turning the roll an activation of the respective display means one after each other is achieved.

Figure 7:
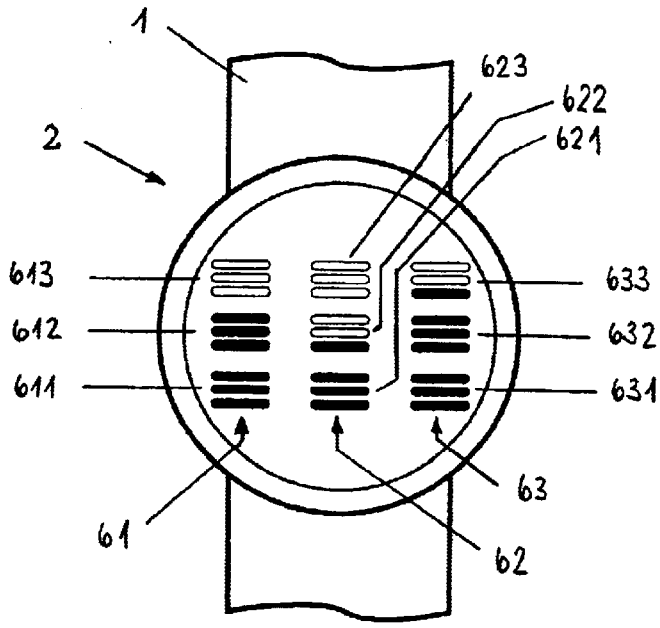
FIG. 7 a representation of a third embodiment for indication of an internet time.

FIG. 7 discloses a third embodiment of the watch 2 which is provided with three groups of display means 61, 62, 63 with each group comprising nine display means, which are respectively combined to each three subgroups 611, 612, 613; 621, 622, 623; 631, 632, 633. This embodiment indicates the known internet time, at which 24 hours are divided into 1000 "Swatch Beats".

Figure 8:
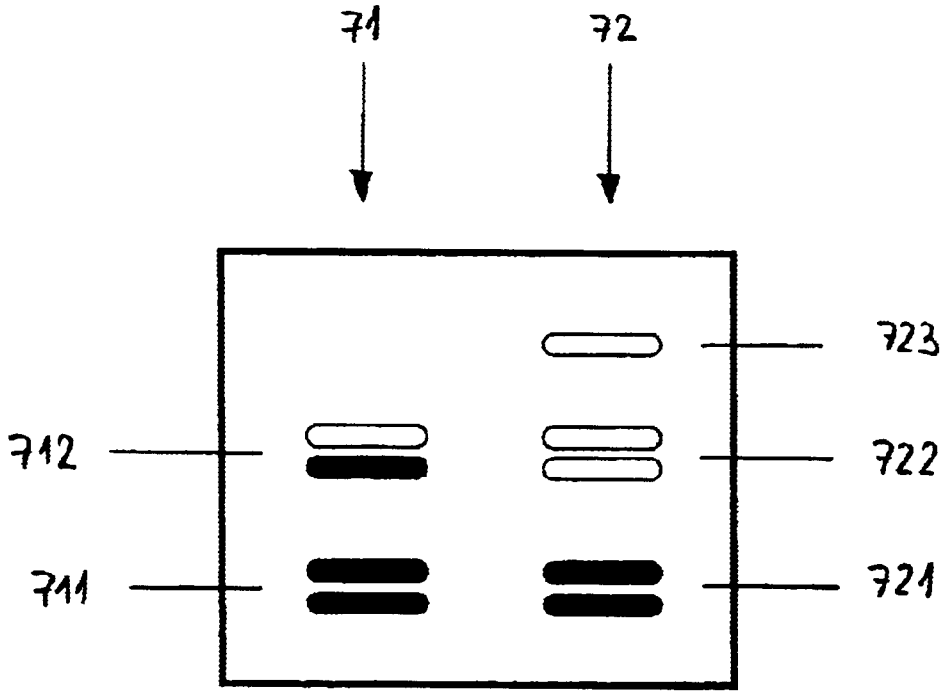
FIG. 8 a fourth embodiment for indication of an elapsed time.

Finally, FIG. 8 discloses a fourth embodiment of the invention which comprises two groups 71, 72 of display means wherein the first group 71 comprises four display means in two subgroups 711, 712 and the second group 72 comprises five display means in three subgroups 721, 722, 723. Both groups serve to indicate the first and second place of a minute number, respectively, so that at maximum 45 minutes can be shown and the watch can for example be used for the indication of a still remaining playing time at a sporting event.

The principles of the display of digits by means of the corresponding number of activated display means as applied to the embodiments shown in FIGS. 7 and 8 correspond to those which were described in connection with FIGS. 1 to 5.

The driving of the display means for representation of time as disclosed above is preferably conducted by means of an integrated circuit comprising an appropriately programmed microprocessor.

Any elements which by activation change an optically perceptible state so that a recognizable representation of time as disclosed above is achieved can be used as display means. Besides the brightness, such states can as well be the colour, a pattern, a surface or similar. The form of the single display means as well is also arbitrary and is only determined by a good readability of the produced representation.

Furthermore, the representation can for example also be generated by means of a projector, a monitor or other media.

The optically separate perceivability of the groups and/or subgroups can be achieved and/or increased by a distance between these groups and/or subgroups and additionally or alternatively by optically perceptible means such as for example lines, framings, elevations, colour and/or brightness contrasts and similar means.

Furthermore, there is the alternative or additional possibility to achieve and/or increase the optically separate perceivability by various embodiments of the display means themselves with respect to their colour, form, size, brightness and so on.

What is claimed is:

1. A watch with a plurality of display means which are individually to be activated or deactivated for representation of a time, including a first group (31) of 12 display means (4) arranged in a row for indication of an hour number between 1 and 12;

a second group (32) of 5 display means (4) arranged in a row for indication of a second place of the minutes (10 minutes) between 0 and 5; and a third group (33) of 9 display means (4) arranged in a row for indication of a first place of the minutes (1 minutes) between 0 and 9;

wherein the display means (4) of every group are additionally divided into between 2 and 4 subgroups so that every subgroup comprises between one and four display means (4);

wherein the groups and subgroups are optically separately perceptible; and wherein the spacing of the subgroups from each other is greater than the spacing of the display means (4) from each other within the subgroups.

2. A watch according to claim 1, wherein the display means (4) of the first group (31) are activated for indication of an hour number between 1 and 12 o'clock starting at a first end of the row and and for indication of an hour number between 13 and 24 o'clock starting at the second end of the row.

3. A watch according to claim 1, wherein the display means (4) of the first group (31) are arranged into four subgroups (311, 312, 313, 314) which each comprise three display means.

4. A watch according to claim 1, wherein the display means (4) of the second group (32) form three subgroups (321, 322, 323) wherein two subgroups (321, 322) each comprise two display means.

5. A watch according to claim 1, wherein the display means (4) of the third group (33) form three subgroups (331, 332, 333) which each comprise three display means.

6. A watch according to claim 1, wherein at least one of the optically separated perceivability of the groups (31, 32, 33) and subgroups (311, 312, 313, 314; 321, 322, 323; 331, 332, 333) is achieved by optically perceptible means.

7. A watch according to claim 1, wherein the display means (4) are formed by luminous elements which are switched on for activation and which are switched off for deactivation.

8. A watch according to claim 1, wherein the display means are formed by liquid crystal display elements which are activated or deactivated by contrast change.

9. A watch according to claim 1, wherein the display means are each formed by a shutter element (8, 81) which is activated or deactivated by a mechanical change of position.

10. A watch according to claim 9, wherein the shutter elements are switched by a mechanical clockwork mechanism.

11. A watch according to claim 1, wherein a switching unit by which a minute and second number or a second and tenth second number or a month and day number can be indicated instead of the hour and minute number.

12. A watch according to claim 1, wherein the groups (31, 32, 33) of the display means (4) are arranged above each other along a bar (5) wherein every display means is provided in the form of a ring enclosing the bar.

13. A watch according to claim 12, wherein the bar (5) is provided in the form of a cylindrical liquid crystal display along which the display means are activated or deactivated.

14. A watch according to claim 1, wherein the display means are represented by projection or on a monitor or via another medium.

* * * * *